US005371484A

United States Patent [19]

Nixon

[11] Patent Number: 5,371,484

[45] Date of Patent: Dec. 6, 1994

[54] INTERNALLY RUGGEDIZED MICROWAVE COAXIAL CABLE

[75] Inventor: Charles E. Nixon, Long Island, N.Y.

[73] Assignee: Insulated Wire Incorporated, Ronkonkoma, N.Y.

[21] Appl. No.: 680,582

[22] Filed: Apr. 4, 1991

[51] Int. Cl.[5] ..... H01P 3/06

[52] U.S. Cl. ..... 333/243; 174/28; 174/108

[58] Field of Search ..... 333/243; 174/28, 108

[56] References Cited

U.S. PATENT DOCUMENTS

| | | | |
|---|---|---|---|
| 2,133,863 | 10/1938 | Knoderer | 174/106 R |
| 3,355,544 | 11/1967 | Costley et al. | 174/106 |
| 4,131,757 | 12/1978 | Felkel | 174/108 X |
| 4,250,351 | 2/1981 | Bridges | 174/108 X |
| 4,408,089 | 10/1983 | Nixon | 333/243 X |
| 4,626,810 | 12/1986 | Nixon | 333/243 |
| 4,719,320 | 1/1988 | Strait, Jr. | 174/108 X |
| 4,731,502 | 3/1988 | Finamore | 174/74 R |
| 5,061,823 | 10/1991 | Carroll | 174/108 X |

*Primary Examiner*—Benny T. Lee
*Attorney, Agent, or Firm*—Parmelee, Bollinger & Bramblett

[57] ABSTRACT

A low attenuation coaxial cable for carrying microwave energy at GigaHertz frequencies includes a center conductor, dielectric surrounding the center conductor and an outer conductor encircling the dielectric. This outer conductor is formed by a plurality of longitudinally extending conductive wire strands positioned adjacent one to another with a slight helical lay along the cable. Internal ruggedization includes a bedding layer of indentable dielectric material encircling the outer conductor with a single-layer ruggedizing winding of strong wire sufficiently tightly wound around the bedding layer for partially indenting this strong wire into the bedding layer. A protective outer jacket of tough plastic material surrounds the ruggedization layer. The helical lay of strong wire in the ruggedization layer is opposite to the slight helical lay of wire strands of the outer conductor. From two to twenty-four individual wires may be included in the ruggedization layer, but the helix angle of each turn of each wire is at least 50°. The maximum VSWR and the attenuation loss throughout a range in frequencies from 0.04 to 18 GHz remained essentially the same in spite of a crushing load up to 180 pounds imposed on two lineal inches of cable length. Cable performance remained essentially constant when tested in an overhand knot and untied. Performance remained essentially constant when bent around a one-quarter inch radius and remained satisfactory even when bent around a one-eighth inch radius.

22 Claims, 8 Drawing Sheets

CABLE PERFORMANCE
VS
CRUSH FORCE

| | PRIOR CABLE | | NEW CABLE | |
|---|---|---|---|---|
| FORCE | MAX VSWR | MAX LOSS(dB) | MAX VSWR | MAX LOSS(dB) |
| 0 | 1.24 | 1.6 | 1.28 | 1.8 |
| 75 | 1.47 | 1.7 | 1.28 | 1.8 |
| 125 | 1.83 | 1.8 | 1.28 | 1.8 |
| 180 | | | 1.34 | 1.9 |
| 200 | | | 1.57 | 2.0 |
| 0 | 1.40 | 1.7 | 1.39 | 1.9 |

FREQUENCY RANGE: .04 TO 18 GHz

FIG. 8

CABLE PERFORMANCE
VS
BEND RADIUS

| | PRIOR CABLE | | NEW CABLE | |
|---|---|---|---|---|
| BEND RADIUS (IN) | MAX VSWR | MAX LOSS(dB) | MAX VSWR | MAX LOSS(dB) |
| STR | 1.29 | 1.8 | 1.21 | 1.8 |
| 1/4 | 1.45 | 1.9 | 1.21 | 1.8 |
| 1/8 | 1.57 | 1.8 | 1.29 | 1.9 |
| STR | 1.31 | 1.8 | 1.24 | 1.8 |

FREQUENCY RANGE: .04 TO 18 GHz

FIG. 10

PERFORMANCE
WITH AND WITHOUT "KNOT"

| | PRIOR CABLE | | NEW CABLE | |
|---|---|---|---|---|
| | MAX VSWR | MAX LOSS(dB) | MAX VSWR | MAX LOSS(dB) |
| STR | 1.29 | 1.7 | 1.24 | 1.9 |
| KNOT (1 3/8 X 1") | 1.46 | 3.0 | 1.22 | 1.9 |
| UNTIED | 1.31 | 1.8 | 1.22 | 1.9 |

FREQUENCY RANGE: .04 TO 18 GHz

INTERNALLY RUGGEDIZED MICROWAVE COAXIAL CABLE

FIELD OF THE INVENTION

The present invention is in the field of microwave coaxial cables for handling microwave signals, i.e. signals in the frequency range from about 0.1 up to about 35 or more GigaHertz (GHz), and more particularly relates to such microwave coaxial cables which are internally ruggedized by an armoring winding located inside of the jacket on the cable.

BACKGROUND

In conventional coaxial cables, a center conductor is surrounded by a dielectric medium which in turn is surrounded by an outer conductive shield serving as an outer conductor positioned generally coaxial with the center conductor. This outer conductor is conventionally formed by a braid of electrical wires and in some cables a second braided shield surrounds the first, and the composite outer conductor is called a double shield braid.

The diameter of the center conductor may be called "d", and the inside diameter of the outer conductor may be called "D". The characteristic impedance (sometimes called the "surge impedance") of a coaxial cable is a function of the "d" to "D" ratio, which is often expressed as "d/D" ratio , wherein "D" is concentric (coaxial) with "d".

Electrical losses which occur in transmitting a microwave signal, i.e., an electrical signal in the frequency range from about 0.1 GHz up to about 35 or more GHz, through a length of coaxial cable depend to a considerable degree upon the nature of the dielectric medium positioned in the region between the inner conductor and the outer conductor. In other words, the dielectric medium is located in the region between the dimensions d and D. Electrical losses which occur in transmitting an electrical signal through a length of coaxial cable are called "attenuation losses".

In U.S. Pat. No. 4,626,810, issued Dec. 2, 1986, to my son, Arthur C. Nixon, is described the desirability for achieving reduced attenuation losses by using low density dielectric medium containing numerous tiny air pockets, for example such as low density (sometimes called "expanded") PTFE dielectric material. In that patent are described and claimed low attenuation microwave coaxial cables for operation in a GHz range, for example up to about 18 GHz, having an arrangement of such low density dielectric material positioned between the center conductor and the outer conductor.

Since the characteristic impedance of a coaxial cable depends upon the d/D ratio of the cable, it will be appreciated that mechanical stresses imposed upon a coaxial cable which cause deformations or distortions away from true concentricity of D relative to d, for example such as caused by squeezing, ovalizing, flattening or squashing of the cable under mechanical loading or bending will cause localized changes or variations in d/D ratio and hence will cause localized changes, variations or discontinuities in the characteristic impedance of the cable. Moreover, it will further be appreciated that a low density dielectric medium having numerous tiny air pockets therein inherently provides less mechanical support for the outer conductor to resist crushing forces than the support provided by high density solid dielectric medium of the same material. Consequently, a microwave coaxial cable having low density dielectric medium providing enhanced electrical performance such as disclosed and claimed in said '810 Patent is likely to be more susceptible to deformations or distortions away from true concentricity for a given mechanical loading or bending than one having a high density dielectric medium, because the outer conductor receives less internal support from a low density dielectric medium.

Such localized changes in characteristic impedance within a coaxial cable due to mechanical loading or bending distortions or deviations in d/D ratio are undesirable because they produce localized impedance mismatching within the cable causing backward reflections of electric signals. The original signals were being propagated in a so-called "forward" direction through the length of coaxial cable, and reflected signals due to impedance mismatching become propagated in a "backward" direction through the same length of cable. The resultant interactions of the forwardly and backwardly propagating signals produce "standing waves" within the coaxial cable. Not only do reflections undesirably weaken (attenuate) the desired forward-going signal but standing waves undesirably increase electrical losses within the cable.

A measurement of the magnitude of standing waves within a microwave cable is the Voltage Standing Wave Ratio (VSWR). In a perfectly uniform and stable coaxial cable having a perfectly impedance matched termination, the VSWR measurement would be 1.00 throughout a desired operating range of frequencies. This optimum VSWR of 1.00 throughout a desired operating range of frequencies in my experience has not been achieved in any commercially available coaxial cable harness.

As further background, it is noted that my U.S. Pat. No. 4,408,089, issued Oct. 4, 1983, discloses an extremely low attenuation low radiation loss flexible coaxial cable for handling microwave energy in the GHz frequency range. In that patent a flexible dielectric medium which covered a center conductor was surrounded by a plurality of longitudinal, parallel, contiguous conductive strands with a slight helical lay which in turn were surrounded by means to hold them in place, including an outer jacket of flexible impermeable material such as plastic. The coaxial cable of that patent provides superior performance with respect to attenuation loss, leakage, and other properties for microwave signals as compared with conventional coaxial cables having braided outer conductors including those having a double shield braid. Each of the contiguous conductive strands is smooth silver plated. All of these strands extend longitudinally of the cable, and they are sufficiently numerous for forming at least two full layers of these strands surrounding the dielectric medium. The inner layer of strands is contiguous to the dielectric medium, and the next layer comprises strands nesting in the valleys defined by the respective neighboring strands of the inner layer. These parallel strands are tightly secured in place retained tightly embraced against the dielectric medium and against each other by a continuous, uniform, tightly fitting, squeezing wrapping serving of strong, fine filaments or fibers which are wound tightly around the longitudinally extending contiguous conductive strands of the outer conductor.

The '089 Patent specifies a particular example in which the longitudinally extending conductive wire strands had a diameter of about 0.004 of an inch, and the wrapping serving was applied directly over the wire strands. This wrapping serving comprised eight multifilament fiber glass threads, each thread being impregnated with FEP (fluorinated ethylene propylene) and having a fiber glass thread diameter of approximately 0.004 of an inch. An outer jacket of flexible impermeable plastic surrounded the wrapping serving for protecting the coaxial cable.

In introductory discussion in the '089 patent preceding the above-described particular example, it is stated that in order to retain the conductive strands of the outer conductor firmly pressed in adjacent relationship one to another and tightly embraced against the outside of the dielectric medium, there is a continuous, uniform, tightly fitting wrapping or serving. This serving is formed of strong stranded or ribbon material capable of withstanding the heat curing temperature of the plastic jacket. The patent states that, for example, this serving is formed of thread, plastic ribbon, metallic ribbon, or wire strands or metallized plastic ribbon, e.g. metallized Mylar. The metallic ribbon or metallized Mylar is employed in order to provide additional shielding against external or internal radiation, if desired, in special applications requiring unusually extreme isolation of the signal being carried in the cable. The '089 Patent explains that in the embodiment being shown, the serving is formed by threads each having a diameter comparable with the diameter of the parallel conductive strands of the outer conductor, namely 0.004 of an inch (American Wire Gage 38). Each thread contains multiple fine filaments, for example glass filaments, with the thread being impregnated with FEP (fluorinated ethylene propylene) or a thread of Nextel filaments (obtainable commercially from 3M Company in Minneapolis, Minn.), with the thread being impregnated with PTFE (polytetrafluoroethylene).

There is no other purpose stated in the '089 Patent for the wrapping serving applied directly over the longitudinally extending contiguous conductive strands of the outer conductor, except to retain the parallel conductive strands of the outer conductor firmly pressed in adjacent relationship one to another and tightly embraced against the dielectric medium.

These contiguous conductive strands comprising the outer conductor in the microwave coaxial cables described in my '089 Patent are silver-coated for increasing surface conductivity of the outer conductor. Arthur Nixon's '810 Patent discloses that incorporation of the low density dielectric medium arrangement described and claimed within a microwave coaxial cable of the structure as disclosed and claimed in the '089 Patent, enhances performance by further reducing attenuation losses.

For many years the coaxial cable industry has protected coaxial cables against crushing or mechanical distortion under squeezing or bending loads by inserting the coaxial cable endwise through a length of flexible conduit armor surrounding the whole cable. This flexible conduit armor consists of a single strip of stainless steel wound helically with each successive turn of the helix being convoluted, so as to interlock with the preceding turn in a manner similar to the construction of flexible steel armor around electrical "BX" cable used in homes and commercial structures for carrying 60 Hz AC electrical power. Among the problems of using such flexible conduit armor placed around the outside of a whole coaxial cable are that it adds about 0.150 of an inch to the outside diameter of the assembly of cable plus armor and it adds considerable size, mass and weight to the assembly as a whole. Further, such flexible conduit armor restricts the ability to bend coaxial cable. Attempts to bend such flexible conduit armor into a circular arc having a bend radius smaller than about 1.2 to about 1.5 inches can split open and dislodge the interlocking convolutions of the stainless steel strip, thereby destroying the armor and creating jagged, dangerous or unsafe sharp edges exposed on the split-apart convolutions of the conduit armor.

Another problem from using such flexible conduit armor around the outside of a whole coaxial cable having construction as described and claimed in the C. E. Nixon '089 Patent incorporating low density dielectric medium as described and claimed in the A. C. Nixon '810 Patent (hereinafter called "the '089+'810 microwave coaxial cable") is that in my experience the cable with its external armor can be bent repeatedly to a radius of about two inches and straightened only about 38 to about 40 times in testing, before breakage occurs; whereas the '089+'810 microwave coaxial cable incorporating the internal ruggedization of the present invention in a preferred form can be bent repeatedly to a radius of about two inches and straightened at least 1,000 times without breaking.

SUMMARY

In accordance with the present invention in a preferred embodiment a low attenuation microwave coaxial cable for carrying microwave energy in the Giga-Hertz frequency range includes a center conductor extending along the axis of the coaxial cable with dielectric surrounding the center conductor and an outer conductor encircling the dielectric. This outer conductor is formed by a plurality of longitudinally extending conductive wire strands positioned adjacent one to another and extending longitudinally of the cable in electrical contact one with another forming an outer conductor encircling the dielectric. The wire strands in the outer conductor are positioned with a slight helical lay along the length of the cable, and they are sufficiently numerous for forming at least two full layers of these wire strands surrounding the dielectric medium. Internal ruggedization of the coaxial cable includes a bedding layer of indentable dielectric material encircling the outer conductor. A ruggedization layer encircling this bedding layer is formed by strong wires helically wound around the bedding layer with turns of said strong wire being adjacent one to another. The helical lay along the cable of the strong wire in the ruggedization layer is in an opposite sense relative to the slight helical lay along the cable of the wire strands of the outer conductor. It is preferred that the strong wire in the ruggedization layer comprise a plurality of individual wires of the same size simultaneously wound to form a single-layer winding around the bedding layer with adjacent turns of wire being in side-by-side contact. The number of individual wires, for example, is in a range from two to twenty-four, and each individual wire in this plurality of wires has a helical lay along the cable at an angle of at least about 50° relative to the axis of the cable. The strong wire is sufficiently tightly wound around the bedding layer for indenting the wire of the ruggedization layer partially into the bedding layer. There is a protective outer jacket of tough plastic material surrounding the ruggedization layer.

Among the many advantages resulting from internally ruggedized microwave coaxial cable embodying the invention in a preferred form are those resulting from the fact that the d/D ratio is maintained essentially uniformly the same along the length of the cable in spite of imposition of a mechanical crushing load up to at least 180 lbs. per two lineal inches of length of the cable. Moreover, the electrical performance of the cable is maintained essentially the same in spite of imposition of a mechanical crushing load up to at least 180 lbs. per two lineal inches of length of the cable.

A coaxial cable having construction as described and claimed in the C. E. Nixon '089 Patent incorporating low density dielectric medium as described and claimed in the A. C. Nixon '810 Patent (namely, "the '089+'810 microwave coaxial cable") shows deterioration in electrical performance when bent around a mandrel having a bend radius less than about one inch in a test set-up as shown and described; whereas such coaxial cable incorporating internal ruggedization embodying the invention in a preferred form shows essentially no deterioration when bent around a mandrel having a bend radius of about one-quarter of an inch.

Among further advantages of the '089+'810 microwave coaxial cable having internal ruggedization embodying the invention in a preferred form is that in an overhand knot test wherein the external dimensions of the overhand knot measure 1 inch by 1⅜ inches, the '089+'810 microwave coaxial cable showed significant variation in maximum VSWR and in maximum power loss over a frequency range from 0.04 GHz to 18 GHz; whereas the '089+'810 microwave coaxial cable having internal ruggedization embodying the present invention in a preferred form showed no significant variation in maximum VSWR nor in maximum power loss over the same frequency range.

Additional advantages of the internally ruggedized microwave coaxial cable as shown and described result from the fact that such cable with suitable electrical connectors on both ends is effectively usable at microwave frequencies up to 60 GHz.

BRIEF DESCRIPTION OF THE DRAWINGS

The invention, together with further objects, features, advantages and aspects thereof will be more clearly understood from the following description considered in conjunction with the accompanying drawings which are not necessarily drawn to scale with the emphasis instead being placed upon clearly illustrating the principles of the invention. Like reference numerals indicate like elements throughout the different views.

FIG. 8 shows crush resistance test results for "PRIOR CABLE", namely the '089+'810 microwave coaxial cable in comparison with "NEW CABLE", namely the microwave coaxial cable of FIGS. 1 and 2.

FIG. 10 shows bend radius test results for PRIOR CABLE in comparison with NEW CABLE.

DETAILED DESCRIPTION OF PREFERRED EMBODIMENTS OF THE INVENTION

Figure 1:
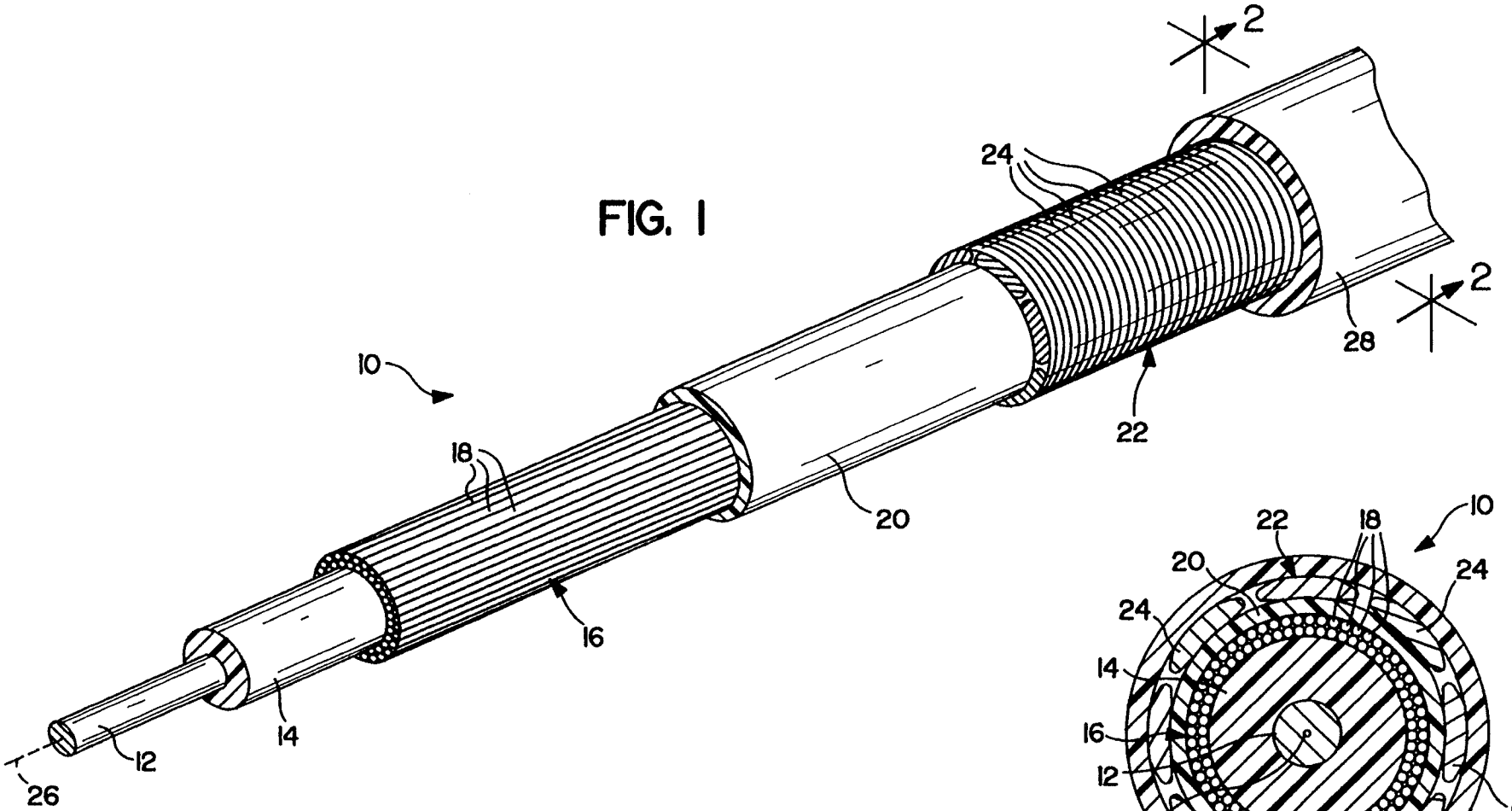
FIG. 1 is a perspective view greatly enlarged of a microwave coaxial cable embodying the internal ruggedization of the present invention in a preferred form. Portions of the layers of the cable are shown progressively removed in order more clearly to illustrate the construction of this cable.
Figure 2:
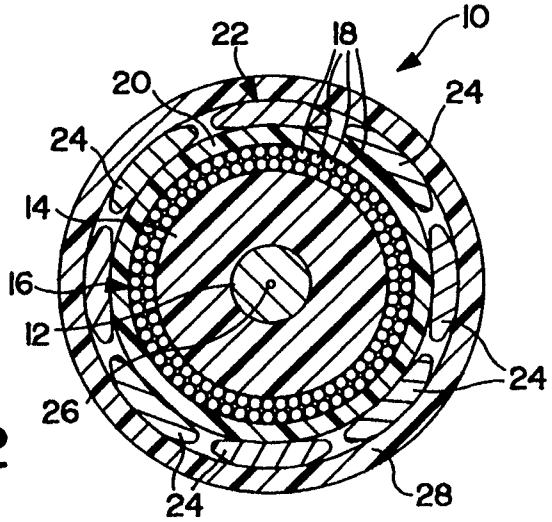
FIG. 2 is a cross sectional view taken along the plane 2—2 in FIG. 1 and shown further enlarged.

A microwave coaxial cable 10 embodying the present invention is shown in FIGS. 1 and 2. The cable comprises a longitudinal center electrical conductor 12 extending along the axis of the cable. In this preferred embodiment, this center conductor is a solid single-strand wire which is silver plated with a very smooth surface.

This center conductor 12 may be silver-plated OFHC (Oxygen Free High Conductivity) copper, or it may be silver-plated copper-clad hard-drawn steel wire if the center conductor is intended to serve as the pin of a male connector or if more tensile strength is desired, or both. This center conductor 12 is surrounded by a flexible dielectric medium 14, preferably having a relatively low dielectric constant. In this preferred embodiment, for example, the dielectric medium 14 may be a low density dielectric medium, which may comprise expanded PTFE material arranged as shown and described in the A. C. Nixon '810 Patent, of which the entire disclosure is incorporated herein by reference.

The dielectric medium 14 is surrounded by an outer conductor 16 coaxial with the center conductor 12 and having a generally circular cylindrical configuration as seen in cross section. This outer conductor is formed by a plurality of conductive elements 18 which in this preferred embodiment are shown as numerous small diameter wire strands extending longitudinally along the cable. All of these longitudinal wire strand elements 18 run parallel adjacent one to another. These wire strands 18 are circular and they are smooth silver-coated. The structure of the outer conductor 16 may be in accordance with my '089 Patent of which the entire disclosure is incorporated herein by reference.

In a preferred embodiment in cable 10 these wire strands 18 all have the same AWG size, and they may be silver-coated OFHC copper wires or they may be silver-coated, copper-clad hard-drawn steel wires. Silver-coated, copper-clad, hard drawn steel wires are used as the wire strands 18 in the outer conductor 16 when it is desired to provide a microwave coaxial cable having greater overall tensile strength than is obtained when silver-coated OFHC copper wires are used as the wire strands 18. For example the wire strands 18 may all have the same size of 38AWG, i.e., they may all have a diameter of about 0.0040 of an inch, and in a preferred construction there may be about 264 of these wire strands in this outer conductor 16 for providing two full layers of wire strands 18 in the outer conductor 16.

Ideally, in accordance with my theory for the lowest attenuation as explained in the '089 Patent, these wire strand elements 18 comprising the outer conductor 16 would extend exactly longitudinally; that is, they would extend exactly straight and parallel to the longitudinal axis of the cable 10.

However, in order to assure uniform distribution of these strands around the dielectric medium 14, the longitudinally extending wire strands 18 are given a very slight helical lay. For example, each strand 18 may be positioned in a very slight right-hand advancing (clockwise advancing) helix configuration, as shown in FIG. 1. The pitch of the very sight helical lay of the elements 18; that is the distance along the cable in which a given wire strand 18 will make one complete turn around the axis of the cable may be of the order of one-half to two feet, depending upon the outside diameter (O.D.) of the dielectric medium. In most cases, the pitch of the very slight helical lay of the wire strands 18 may preferably be at least about fifty times the inside diameter (I.D.) of the outer conductor 16, where the outside diameter (O.D.) of the dielectric medium 14 is considered to be equal to the I.D. of the outer conductor and may have a nominal value of about 0.136 of an inch, as set forth in the Example below.

Encircling the outer conductor 16 there is shown a bedding layer 20. This bedding layer 20 may advantageously comprise an indentable dielectric material, for example, such as an unsintered layer of expanded (low density) PTFE material having a thickness about equal to the diameter of one of the wire strands 18, for example, having a thickness of about 0.004 of an inch.

A ruggedization layer 22 encircles the bedding layer 20 formed by strong wire 24 helically wound around the bedding layer with turns of the strong wire being adjacent one to another in side-by-side contact. It is preferred that the helical lay along the cable of the strong wire 24 be opposite in sense to the slight helical lay of the wire strands 18 in the outer conductor 16. Thus, for example the wire 24 in the ruggedization layer 22 is shown in FIG. 1 as having a left hand advancing (counterclockwise advancing) helix configuration.

In this example as shown, the strong wire 24 preferably may have a diameter of at least about three times the diameter of a wire strand 18 in the outer conductor 16 and may be hard-drawn steel wire having a smooth silver coating, for example silver-coated copper-clad steel wire hard-drawn meeting ASTM Designation B501-88, Class 40HS may be used to advantage. For example, wire 24 advantageously may have a diameter of about four times the diameter of a wire strand 18; for example may have a diameter of about 0.0159 of an inch, corresponding to AWG No. 26.

It is my theory that each turn of the wound wire 24 in the ruggedization layer 22 generally acts as a "circular hoop" for resisting crushing forces and/or for resisting flattening or ovalizing forces resulting from bending or flexing of the cable 10. In accord with this theory, the optimum ruggedization effect would be obtained if each turn of wire 24 would close on itself so as to be perpendicular to the axis of the cable 10 in order to form a circular hoop. In other words, each turn of wire 24 would lie at an angle of 90° relative to the axis of the cable 10.

Each turn of wire 24 in the circular cylindrical winding layer 22 which is concentric about the axis of cable 10 has a configuration of a helix, therefore it is not possible that a turn would close upon itself at 90° relative to the cable axis. The closest approach to a 90° optimum orientation for each turn in accord with the above "circular hoop" theory is achieved by using only one individual wire for making the circular cylindrical ruggedization winding layer 24.

Regardless of whether or not the above "circular hoop" theory is correct, it is noted that considerable time is required to produce a predetermined length of such cable 10 when winding only one individual wire 24 in each turn of the layer 22. Accordingly, as a practical compromise between optimum ruggedization in accord with the "circular hoop" theory and reasonable production rate for the ruggedization layer 22 it is preferred that this layer may include a plurality of individual wires 24 all of the same size and simultaneously wound in a single layer as shown. The number in this plurality of individual wires may be between 2 and 24. It is preferred that each wire in this plurality of wires have a helical lay along the cable at a helix angle "A" (FIG. 3A) of at least about 50° relative to the axis of the cable 10. It is noted that the more individual wires of a given AWG size which are included in a ruggedization layer of given I.D., the smaller will be the helix angle "A" (FIG. 3A) of each turn. Therefore, in constructing such a cable, if it happens that a total of twenty-four individual wires would cause a helix angle "A" (FIG. 3A) to be less than about 50°, it is preferred that fewer than twenty-four individual wires be used so as to cause the helix angle A to be at least 50°.

Figure 3:
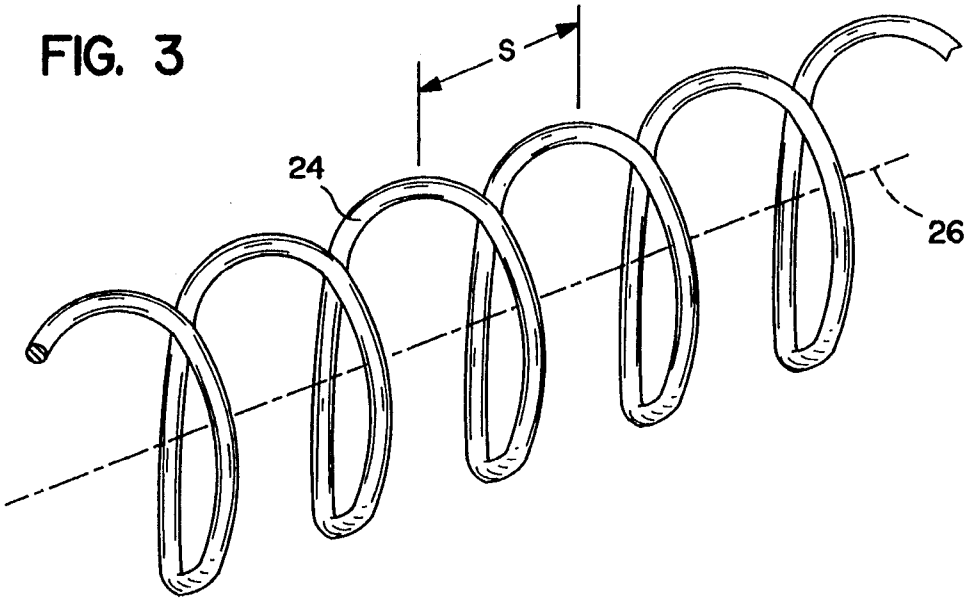
FIG. 3 is a perspective view greatly enlarged of the helix configuration of one of a plurality of strong wires in the internal ruggedization layer in the microwave coaxial cable of FIGS. 1 and 2. For clarity of illustration the helix configuration as shown in FIG. 3 has a "right-hand advancing" (clockwise advancing) sense of lay; whereas the sense of lay of the plurality of strong wires in the internal ruggedization layer as actually shown in FIG. 1 is "left-hand advancing" (counterclockwise advancing).

In this example as shown, there are eight individual wires 24. FIG. 3 is a perspective view greatly enlarged of the helix configuration of one of these eight strong wires. For clarity of illustration of the helix configuration of one individual wire 24 out of a total of eight wires, the helix configuration is shown in FIG. 3 with a clockwise advancing sense of lay. The axial spacing "S" in FIGS. 3 and 3A shows the relative center-to-center spacing of one wire 24 in one turn of a ruggedization winding layer 22 including eight wires in one layer.

Figure 3A:
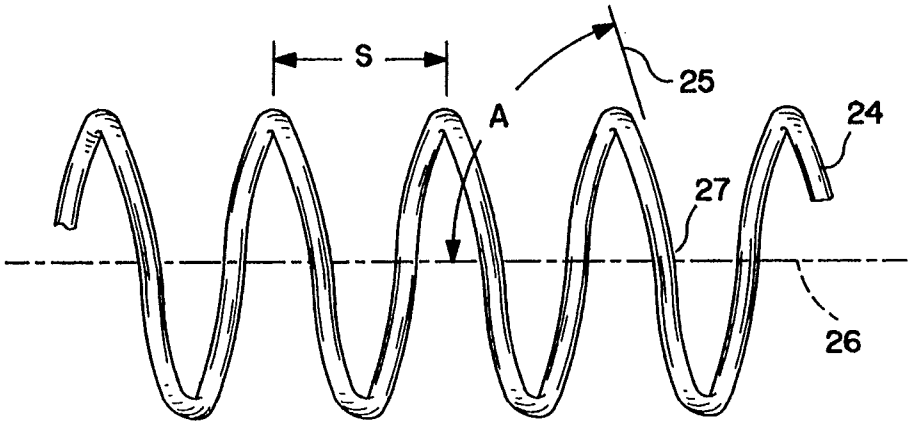
FIG. 3A is a side elevational view of the helix configuration shown in FIG. 3 for purposes of explanation. This helix configuration of one wire has an axial spacing and an angle relative to the axis of the cable which occurs when the ruggedization layer includes eight individual strong wires each having the same size. The term "same size" means having the same American Wire Gage (AWG) Number.

In FIGS. 3 and 3A a dashed line 26 indicates the axis of the microwave coaxial cable 10. In FIG. 3A, the angle "A" is the helix angle of the helical lay of one of the eight wires 24 in the ruggedization layer 22, i.e., it is an acute angle relative to the axis 26 as seen in side elevation of a line 25 tangent to wire 24 at the point 27 where the wire 24 appears to cross the axis 26. In order to obtain a desired ruggedization "circular hoop" effect as explained above, the angle A is preferred to be at least about 50°.

Figure 4:
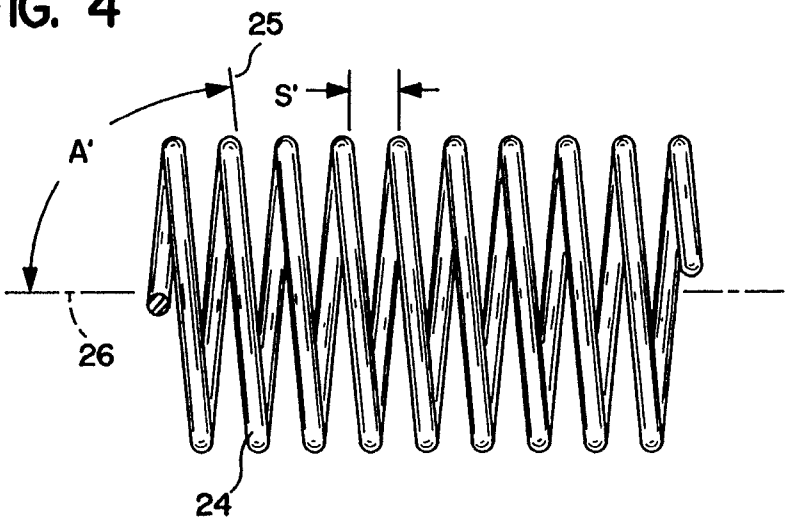
FIG. 4 is a side elevational view of a helix configuration of one wire having an axial spacing and an angle relative to the axis of the cable when the ruggedization layer includes two wires of the same size.

In FIG. 4 is shown a side elevational view showing the relative center to center spacing S' of one wire 24 in one turn of a ruggedization winding layer 22 including two individual wires of the same AWG size simultaneously wound in one layer. It is noted that the center-to-center spacing S' in FIG. 4 becomes less than S in FIG. 3A as the number of individual wires is decreased from eight, and the helix angle A' in FIG. 4 increases toward 90° as this number is decreased. Consequently, it will be understood that increasing the number of individual wires above eight will increase the center-to-center spacing above S and will decrease the helix angle below A.

Surrounding the ruggedization layer 22 (FIGS. 1 an 2) is an outer jacket 28 (FIGS. 1 and 2) of tough, durable, flexible dielectric material, for example in the form of multiple layers of high density PTFE tape applied unsintered and then heat cured in place to form this outer jacket 28 having a thickness, for example, of about 0.011 of an inch. For example, the outer jacket 28 may be multi-ply high density PTFE laminate per federal specification L-P-403 heat cured in place on the cable 10 (FIGS. 1 and 2).

In one embodiment of such a high performance microwave coaxial cable 10 having a nominal characteristic impedance (surge impedance) of 50 ohms, the respective components as described above had the following respective outside diameters (O.D.):

EXAMPLE I

| Cable Component: | Nominal Diameter (Inches): |
|---|---|
| Center Conductor 12 | 0.051 |
| Low Density Dielectric 14 | 0.136 |
| Outer Conductor 16 | 0.155* |
| Bedding Layer 20 | 0.164* |
| Ruggedization Layer 22 | 0.198 |
| Outer Jacket 28 | 0.220 |

*These nominal dimensions can vary plus or minus 0.002" due to resilience of the structure.

Figure 5:
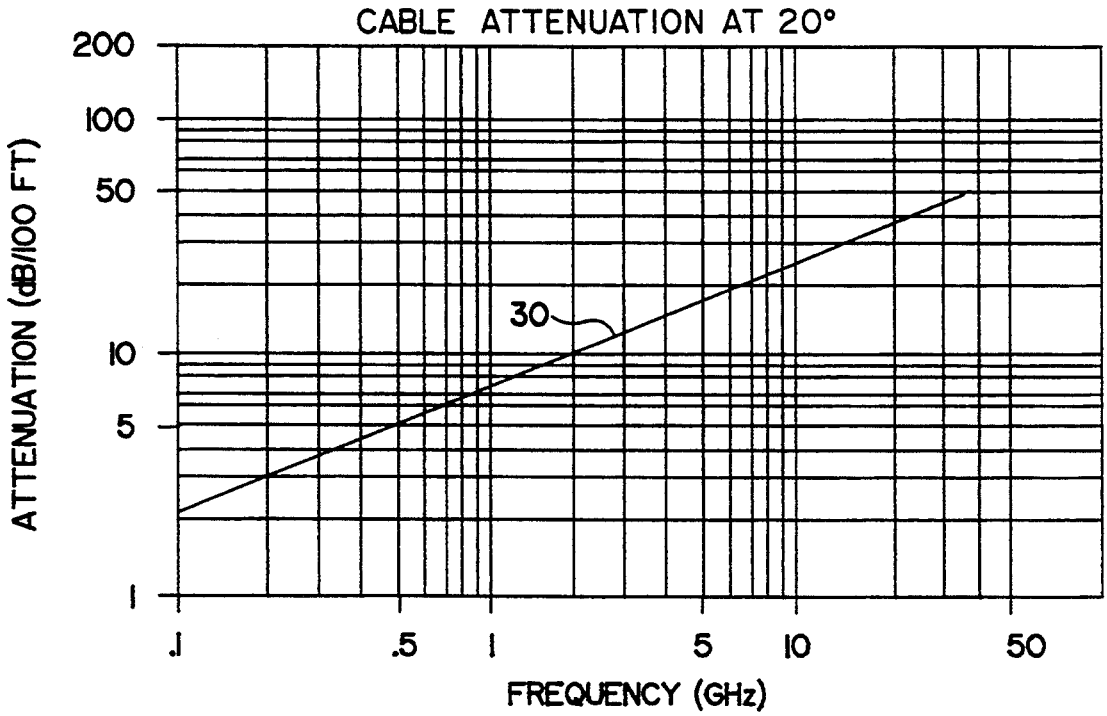
FIG. 5 shows a plot of Attenuation Loss at 20° C. of the microwave coaxial cable of FIGS. 1 and 2 as a function of Frequency in GHz. This Attenuation Loss is graphed with decibels per 100 feet along the vertical axis (ordinate values) and Frequency in GHz along the horizontal axis (abscissa values).

FIG. 5 shows a plot 30 of Attenuation Loss of the microwave coaxial cable 10 of Example I in decibels (dB) per one hundred feet at 20° C. as a function of Frequency in GHz. This plot 30 shows a loss of only about 53 dB per 100 feet at 35 GHz.

Figure 6:
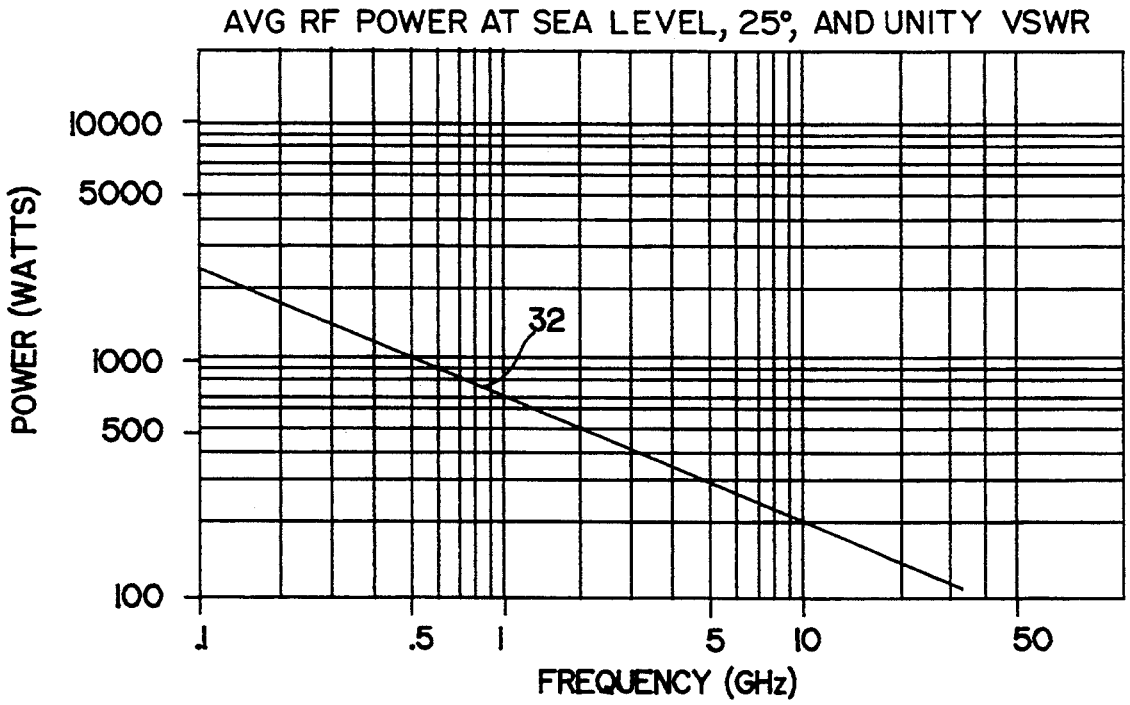
FIG. 6 shows a plot of average power carrying capability of the microwave coaxial cable of FIGS. 1 and 2 as a function of Frequency in GHz. The Average RF (Radio Frequency) Power is shown for use of this microwave coaxial cable at Sea Level at 25° C. and at VSWR of Unity. Power in Watts is plotted along the vertical axis and Frequency in GHz is plotted along the horizontal axis.

FIG. 6 shows a plot 32 of Average RF (Radio Frequency) Power carrying capability in Watts at Sea Level at 25° C. and at Unity VSWR of the microwave coaxial cable 10 of Example I as a function of Frequency in GHz. This plot shows an average power carrying capability of more than about 200 Watts at 35 GHz.

Figure 7:
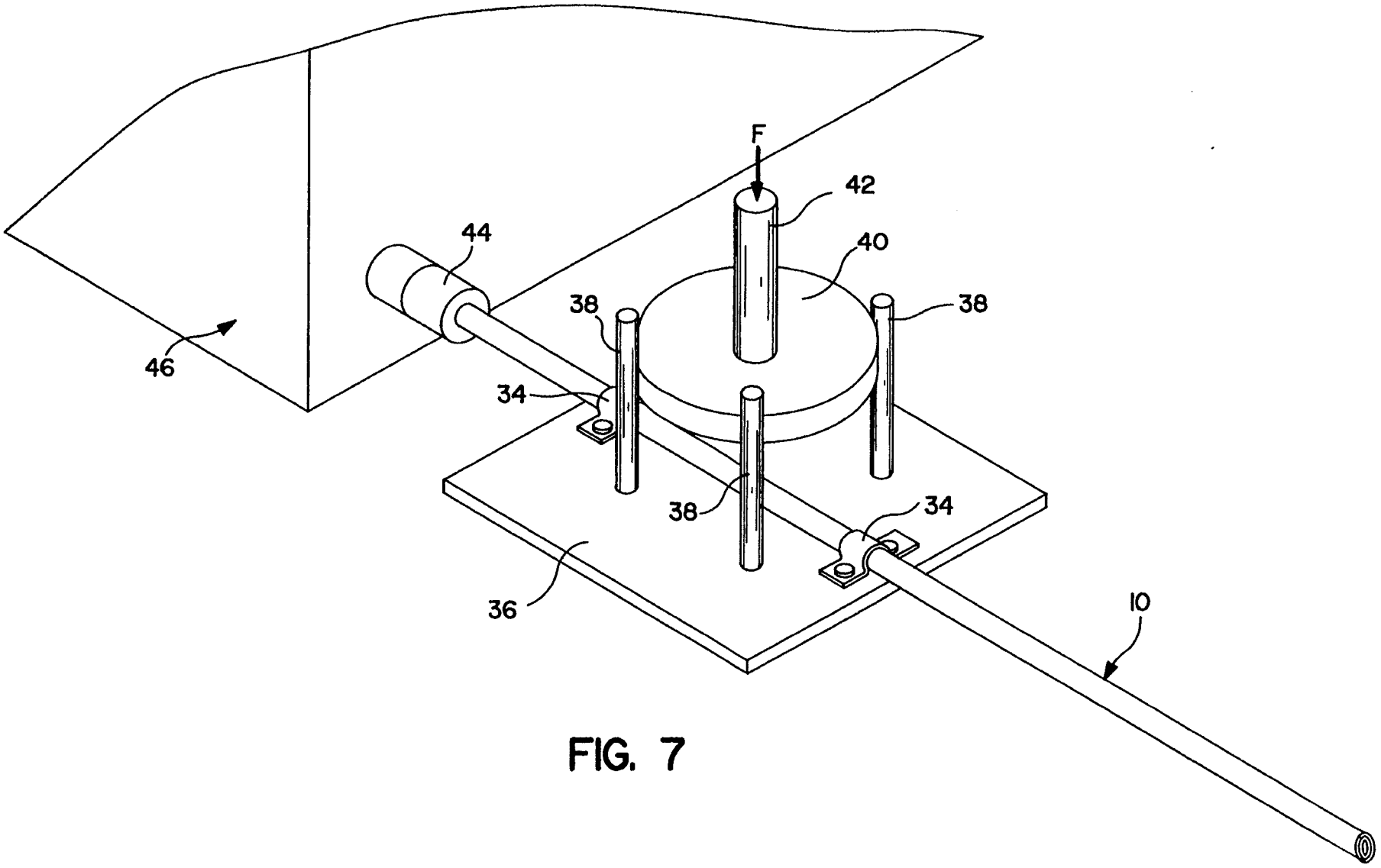
FIG. 7 is a perspective view of a test fixture for testing crush resistance of the microwave coaxial cable of FIGS. 1 and 2.

FIG. 7 is a perspective view of a test fixture for testing crush resistance of the microwave coaxial cable 10 of Example I. The cable 10 is held by a pair of cable clamps 34 to a rigid base plate 36 having four upstanding vertical guide posts 38 (only three are seen) positioned in a square pattern. The cable 10 extends midway between pairs of these guide posts 38.

In order to apply a vertical crushing force "F", there is a rigid circular horizontal disk 40 two inches in diameter concentrically mounted on the bottom of a force-applying plunger rod 42. A slight clearance is provided between guide posts 38 and test disk 40 so that these guides maintain the disk centered over cable 10 without impeding the disk while force F is being applied to the cable or removed. Since the disk 10 has a diameter of two inches, it will be understood that two lineal inches of the cable 10 are being subjected to the applied crushing force F.

In FIG. 7 the cable 10 is connected by a cable connector 44 to a VNA Test Set 46 for measuring VSWR over a frequency range from 0.04 up to 18 GHz, and the center of disk 40 is 12 inches from the end of connector 44. The cable 10 has its other end (not shown) connected to a test receiver for measuring attenuation loss over this range of frequencies.

FIG. 8 shows cable performance test results using the test fixture of FIG. 7 with a prior cable and with the new cable 10. It is again noted that the crush force in pounds is being applied over two lineal inches of the cable. Increasing from a crush force loading of zero to 75 pounds during testing over the frequency range from 0.04 GHz to 18 GHz, caused the maximum VSWR of the prior cable to change from 1.24 to 1.47 (an increase of about 19%); whereas the maximum VSWR of the new cable 10 remained constant at 1.28 under such crush force loading over this frequency range. The maximum loss of the prior cable increased from 1.6 to 1.7 dB (an increase of about 6%); whereas the maximum loss of the new cable remained constant at 1.8 dB.

In going from a crush force loading of zero to 125 pounds during testing over the frequency range from 0.04 GHz to 18 GHz, the maximum VSWR of the prior cable changed from 1.24 to 1.83 (an increase of about 48%); whereas the maximum VSWR of the new cable 10 remained constant at 1.28 under such crush force loading over this frequency range,. The maximum loss of the prior cable increased from 1.6 to 1.8 dB, (an increase of about 13%); the maximum loss of the new cable remained constant at 1.8 dB.

It was found impractical to load the prior cable above 125 pounds due to its considerable flattening under 125 pounds of loading.

When the crush force was removed, the prior cable now showed a maximum VSWR of 1.40 compared to the initial value of 1.24 (about 13% increase), and it now showed a maximum loss of 1.7 dB (about 6% increase from its initial value of 1.6 dB).

The new cable showed a constant maximum VSWR of 1.28 up to a crush force of 125 pounds. Increasing the crush force to 180 pounds on the new cable produced a maximum VSWR of 1.34 (about 5% increase from the initial value of 1.28). Applying a crush force of 200 pounds on the new cable caused a maximum VSWR of 1.57 (about 23% increase from the initial value of 1.28).

The new cable showed a constant maximum loss of 1.8 dB up to a crush force of 125 pounds. At a crush force of 180 pounds its maximum loss was 1.9 dB (about 5.6% increase from the initial 1.8 dB). Increasing the crush force to 200 pounds caused a maximum loss of 2.0 dB (only about 11% increase from the initial 1.8 dB).

When the crush force was removed, the new cable now showed a maximum VSWR of 1.39 (only about 8.6% increase from the initial 1.28), and it now showed a maximum loss of 1.9 dB (only about 5.6% increase from the initial 1.8 dB). Thus, the new cable 10 showed a better spring back (a better self-restoration) toward its initial values after subjection to a crush force of 200 pounds than the prior cable after subjection to a crush force of only 125 pounds.

Figure 9:
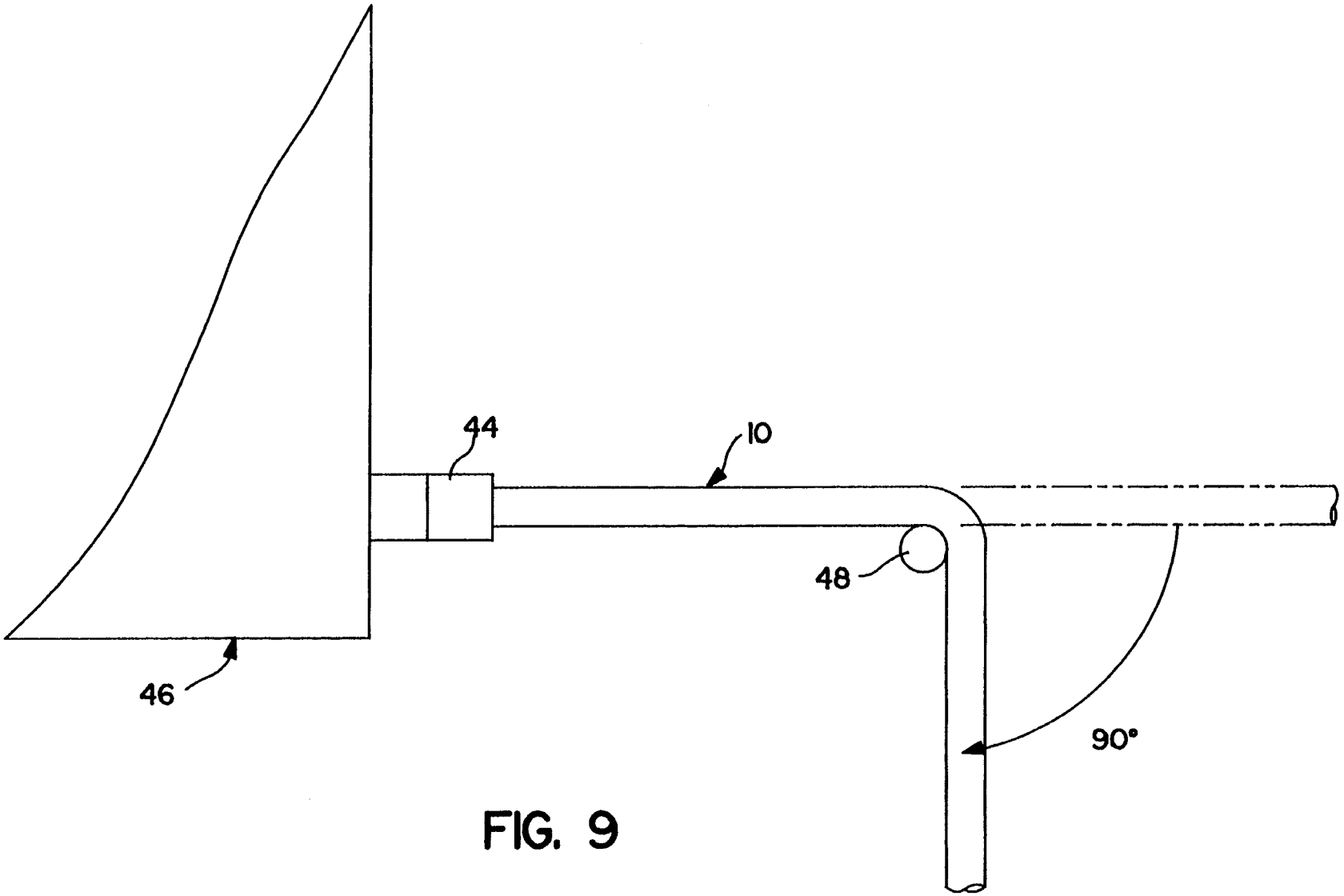
FIG. 9 shows a test fixture for a bend radius testing of microwave coaxial cable.

FIG. 9 shows a bend radius test fixture including a mandrel 48 positioned twenty-four inches from the test set 46. The cable being tested is bent 90° around the mandrel 46 in this bend test. The other end of the cable (not shown) is connected to a test receiver for measuring attenuation loss over the test range of frequencies.

FIG. 10 shows cable performance versus bend radius over a frequency range from 0.04 GHz to 18 GHz. It may be noted by a reader that initial values of VSWR and dB loss in FIG. 10 differ in some columns from initial values in FIG. 8. These modest initial differences arise from the fact that performance at GHz frequencies is affected by very small differences in the precision of mechanical connection relationships between a cable and its connector 44. Consequently, the important criteria are percentage increases from respective initial values. The smaller percentage increase in each case, the better the performance of the cable.

In bending from an initial straight (STR) condition around a mandrel bend radius of ½ inch, the maximum VSWR of the prior cable changed from 1.29 to 1.45 (an increase of about 12%); the new cable remained constant at 1.21 maximum VSWR. The maximum loss of the prior cable increased from 1.8 to 1.9 dB, and the maximum loss of the new cable remained constant.

In further bending around a mandrel bend radius of ⅛ inch, the maximum VSWR of the prior cable became 1.57 (an increase of about 22% from 1.29). The maximum VSWR of the new cable became 1.29 (an increase of about 6.6% from 1.21). The maximum loss of the prior cable returned to 1.8 dB, and the maximum loss of the new cable increased from its previous constant value of 1.8 to 1.9 dB.

After straightening out the previously bent cable, the maximum VSWR of the prior cable returned to 1.31 (an increase of about 1.6% from its initial value of 1.29). The maximum VSWR of the new cable returned to 1.24 (an increase of about 2.5% from its initial value of 1.21). The maximum loss of both cables returned to their initial value of 1.8 dB.

Figures 11, 12:
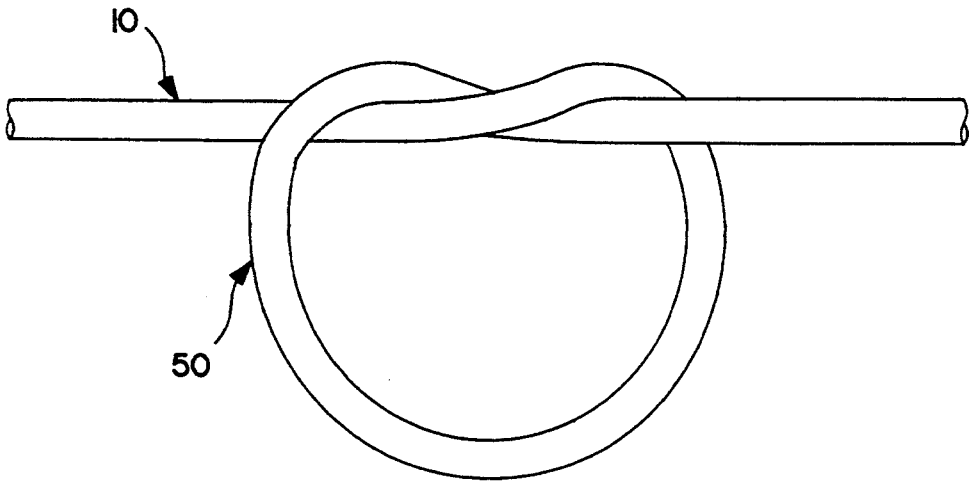
FIG. 11 shows an overhand knot test.
FIG. 12 shows overhand knot test results for PRIOR CABLE in comparison with NEW CABLE.

FIG. 11 shows an overhand knot test, in which the length of the knot 50 in a direction along the length of the cable is 1⅜ inches. The width of the knot 50 in a direction perpendicular to the cable length is one inch.

FIG. 12 shows the cable performance test results during a knot test performed as shown in FIG. 11. The maximum VSWR of the prior cable increased from 1.29 to 1.46 (an increase of about 13%) when knotted and returned to 1.31 (an increase of about 1.6%) when untied. The maximum VSWR of the new cable decreased from 1.24 to 1.22 (a decrease of about 1.6%) when knotted and remained at 1.22 when untied.

The maximum loss of the prior cable increased from 1.7 to 3.0 dB (an increase of about 176%) when knotted and returned to 1.8 dB (an increase of about 5.9%) when untied. The maximum loss of the new cable remained constant at 1.9 when knotted and again when untied.

Since other changes and modifications varied to fit particular operating requirements and environments will be recognized by those skilled in the art, the invention is not considered limited to the examples chosen for purposes of illustration, and includes all changes and modifications which do not constitute a departure from the true spirit and scope of this invention as claimed in the following claims and equivalents thereto.

I claim:

1. In a low attenuation microwave coaxial cable for carrying microwave energy in the GigaHertz frequency range having a center conductor extending along a central longitudinal axis of the coaxial cable, a dielectric surrounding said center conductor, a plurality of conductive wire strands adjacent one another extending longitudinally relative to said central longitudinal axis, said conductive wire strands having a helical lay along the cable and being in electrical contact with one another to realize an outer conductor encircling said dielectric, means for internally ruggedizing said microwave coaxial cable comprising:

a bedding layer of indentable dielectric material encircling said outer conductor in direct contact with said wire strands of said outer conductor;

a ruggedization layer encircling said bedding layer comprised of wire helically wound around said bedding layer;

said helically wound wire in said ruggedization layer being round wire and having turns adjacent one another and in contact with one another;

said round wire in said ruggedization layer being sufficiently tightly wound around said bedding layer for indenting said round wire partially into said bedding layer;

each turn of said round wire in said ruggedization layer being oriented at a helix angle of at least 50 degrees relative to said longitudinal axis;

said round wire in said ruggedization layer being hard-drawn wire; and a protective jacket of plastic material surrounding said ruggedization layer.

2. In a low attenuation microwave coaxial cable for carrying microwave energy in the GigaHertz frequency range, means for internally ruggedizing said microwave coaxial cable claimed in claim 1, in which:

said bedding layer is comprised of unsintered expanded PTFE tape; and said bedding layer has a thickness of about 0.004 of an inch.

3. In a low attenuation microwave coaxial cable for carrying microwave energy in the GigaHertz frequency range, means for internally ruggedizing said microwave coaxial cable claimed in claim 1, in which:

said wire in said ruggedization layer is hard-drawn steel wire having an outer coating of silver.

4. In a low attenuation microwave coaxial cable for carrying microwave energy in the GigaHertz frequency range, means for internally ruggedizing said microwave coaxial cable claimed in claim 1, in which:

said wire in said ruggedization layer includes a plurality of wires, said plurality is a number in the range from two to twenty, each wire in said plurality has a diameter of a same size, and each wire in said plurality has a respective helix configuration, the respective helix configuration of each wire in said plurality is identical to realize a ruggedization layer having a radial thickness equal to the diameter of one of said wires.

5. In a low attenuation microwave coaxial cable for carrying microwave energy in the GigaHertz frequency range, means for internally ruggedizing said microwave coaxial cable claimed in claim 1, in which:

said conductive wire strands are round in cross section, said bedding layer has a thickness about equal to a diameter of a conductive wire strand of said outer conductor.

6. In a low attenuation microwave coaxial cable for carrying microwave energy in the GigaHertz frequency range, means for internally ruggedizing said microwave coaxial cable claimed in claim 1, in which:

said hard-drawn wire in said ruggedization layer has a circular cross section having a diameter of about 0.016 of an inch.

7. In a low attenuation microwave coaxial cable for carrying microwave energy in the GigaHertz frequency range, means for internally ruggedizing said microwave coaxial cable claimed in claim 1, in which:

said hard-drawn wire is silver-coated, round, copper-clad hard-drawn steel wire meeting ASTM Designation B501-88 "Standard Specification for Silver-Coated, Copper-Clad Wire for Electronic Application".

8. In a low attenuation microwave coaxial cable for carrying microwave energy in the GigaHertz frequency range, means for internally ruggedizing said microwave coaxial cable claimed in claim 1, in which:

said hard-drawn wire is round wire of American Wire Size No. 26 having a nominal diameter of 0.0159 of an inch.

9. In a low attenuation microwave coaxial cable for carrying microwave energy in the GigaHertz frequency range, means for internally ruggedizing said microwave coaxial cable claimed in claim 1, in which:

said conductive wire strands are round, and said hard-drawn wire in said ruggedization layer is round wire having a diameter at least about three times larger than any diameter of any round conductive wire strand of said outer conductor.

10. A low attenuation microwave coaxial cable for use in the GigaHertz frequency range, having a center conductor extending along a central longitudinal axis of the coaxial cable, a dielectric surrounding said center conductor, a plurality of conductive round wire strands adjacent one another and extending longitudinally of the cable relative to said central longitudinal axis, said conductive round wire strands having a helical lay along the cable and being in electrical contact with one another to realize an outer conductor encircling said dielectric, said microwave coaxial cable further comprising:

a bedding layer of indentable dielectric material encircling said outer conductor;

a plurality of hard-drawn round wires, all of a same diameter, helically wound around said bedding layer in side-by-side contact sufficiently tightly for partially indenting each of said hard-drawn wires into said bedding layer;

each hard-drawn round wire having an outer coating of silver;

each said hard-drawn round wire having a diameter equal to about four times a diameter of a conductive round wire strand of said outer conductor;

said hard-drawn round wires each having a helical lay along the cable at a helix angle of at least about 50° relative to said central longitudinal axis; and a protective jacket of plastic material surrounding said ruggedization layer.

11. In a low attenuation microwave coaxial cable for carrying microwave energy in the GigaHertz frequency range having a center conductor extending along a central longitudinal axis of the coaxial cable, a dielectric surrounding said center conductor, a plurality of conductive wire strands adjacent one another extending longitudinally relative to said central longitudinal axis, said conductive wire strands having a helical lay along the cable and being in electrical contact with one another to realize an outer conductor encircling said dielectric, means for internally ruggedizing said microwave coaxial cable comprising:

a bedding layer of indentable dielectric material encircling said outer conductor in direct contact with said wire strands of said outer conductor;

a ruggedization layer encircling said bedding layer comprised of a plurality of wires helically wound around said bedding layer;

said plurality of said helically wound wires in said ruggedization layer being round wires and having turns adjacent one another;

said round wires in said ruggedization layer being sufficiently tightly wound around said bedding layer for indenting said round wires partially into said bedding layer;

each turn of said round wires in said ruggedization layer being oriented at a helix angle of at least 50 degrees relative to said longitudinal axis;

said round wires in said ruggedization layer being hard-drawn steel wires having an outer coating of silver;

said plurality of said round wires being a number in the range from two to twenty;

each round wire in said plurality having a diameter, and the diameters of all wires in said plurality being a same size;

said conductive wire strands being round and having diameters of a same size;

the diameters of said hard-drawn steel wires in said ruggedization layer being at least about three times the diameters of said conductive wire strands; and a protective jacket of plastic material surrounding said ruggedization layer.

12. In a low attenuation microwave coaxial cable for carrying microwave energy in the GigaHertz frequency range having a center conductor extending along a central longitudinal axis of the coaxial cable, a dielectric surrounding said center conductor, a plurality of conductive wire strands adjacent one another extending longitudinally relative to said central longitudinal axis, said conductive wire strands having a helical lay along the cable and being in electrical contact with one another to realize an outer conductor encircling said dielectric, means for internally ruggedizing said microwave coaxial cable comprising:

a bedding layer of indentable dielectric material encircling said outer conductor in direct contact with said wire strands of said outer conductor;

a ruggedization layer encircling said bedding layer comprised of a plurality of wires helically wound around said bedding layer;

said helically wound wires in said ruggedization layer being round wires and having turns adjacent one another;

said plurality of said round wires in said ruggedization layer being sufficiently tightly wound around said bedding layer for indenting said round wires partially into said bedding layer;

each turn of said plurality of said round wires in said ruggedization layer being oriented at a helix angle of at least 50 degrees relative to said longitudinal axis;

said plurality of said round wires being a number in the range from two to twenty;

each round wire in said plurality of said round wires having a diameter of a same size;

each round wire in said plurality of said round wires having a respective helix configuration, the respective helix configuration of each round wire in said plurality of said round wires being identical to realize a ruggedization layer having a radial thickness equal to the diameter of one of said wires;

each round wire in said plurality of said round wires in said ruggedization layer being a round, hard-drawn steel wire having an outer coating of silver; and a protective jacket of plastic material surrounding said ruggedization layer.

13. A low attenuation microwave coaxial cable for use in the GigaHertz frequency range having a center conductor extending along a central longitudinal axis of the coaxial cable, a dielectric surrounding said center conductor, a plurality of conductive round wire strands adjacent one another and extending longitudinally of the cable relative to said central longitudinal axis, said conductive round wire strands having a helical lay along the cable and being in electrical contact with one another to realize an outer conductor encircling said dielectric, said microwave coaxial cable further comprising:

a bedding layer of indentable dielectric material encircling said outer conductor;

said bedding layer having a radial thickness about equal to a diameter of a conductive round wire strand of said outer conductor;

a plurality of hard-drawn round wires, all of a same diameter, helically wound around said bedding layer in side-by-side contact sufficiently tightly for partially indenting each of said hard-drawn wires into said bedding layer;

said hard-drawn wires each having a helical lay along the cable at a helix angle of at least about 50° relative to said central longitudinal axis;

each hard-drawn wire having a helical lay along the cable relative to said central longitudinal axis in an opposite sense relative to the helical lay of said conductive round wire strands of said outer conductor; and a protective jacket of plastic material surrounding said ruggedization layer.

14. A low attenuation microwave coaxial cable for use in the GigaHertz frequency range, as claimed in claim 13, wherein:

each said hard-drawn round wire is hard-drawn steel having an outer coating of silver; and each said hard-drawn round wire has a diameter of at least about three times a diameter of a conductive round wire strand of said outer conductor.

15. A method for internally ruggedizing a low attenuation microwave coaxial cable for use in the GigaHertz frequency range having a center conductor extending along a central longitudinal axis of the coaxial cable, a dielectric surrounding said center conductor, a plurality of round wire strands adjacent one another extending longitudinally of the cable relative to said longitudinal axis, said wire strands having a helical lay along the cable and being in electrical contact with one another to realize an outer conductor encircling said dielectric, said method for internally ruggedizing a low attenuation microwave coaxial cable comprising the steps of:

applying a bedding layer of indentable dielectric material encircling said outer conductor;

providing said bedding layer with a radial thickness about equal to a diameter of a round wire strand of said outer conductor;

helically winding a ruggedization layer of hard-drawn round wire around said bedding layer;

said helically wound hard-drawn round wire in said ruggedization layer having an outer coating of silver; said helically wound hard-drawn round wire in said ruggedization layer having turns;

positioning said turns adjacent one another;

helically laying each turn of said helically wound hard-drawn round wire along the cable at a helix angle of at least 50° relative to said longitudinal axis of the cable;

winding said helically wound hard-drawn round wire in said ruggedization layer sufficiently tightly around said bedding layer for indenting said hard-drawn round wire partially into said bedding layer; and applying a protective jacket of plastic material surrounding said ruggedization layer.

16. A method for internally ruggedizing a low attenuation microwave coaxial cable for use in the GigaHertz frequency range having a center conductor extending along a central longitudinal axis of the coaxial cable, a dielectric surrounding said center conductor, a plurality of round wire strands adjacent one another extending longitudinally of the cable relative to said longitudinal axis, said wire strands having a helical lay along the cable and being in electrical contact with one another to realize an outer conductor encircling said dielectric, said method for internally ruggedizing a low attenuation microwave coaxial cable comprising the steps of:

applying a bedding layer of indentable dielectric material encircling said outer conductor;

providing a plurality of hard-drawn round wires in a range of numbers of such wires from two to twenty;

providing all of said plurality of hard-drawn round wires of a same diameter;

selecting said diameter of said hard-drawn round wires in said plurality to be at least about three times a diameter of a round wire strand of said outer conductor;

helically winding a ruggedization layer of said plurality of said hard-drawn round wires around said bedding layer, said helically wound hard-drawn round wires in said ruggedization layer having turns;

positioning said turns adjacent one another;

helically laying each turn of said plurality of said hard-drawn round wires along the cable at a helix angle of at least 50° relative to said longitudinal axis of the cable;

winding said plurality of said hard-drawn round wires in said ruggedization layer sufficiently tightly around said bedding layer for indenting said hard-drawn round wires partially into said bedding layer;

arranging for each of said hard-drawn round wires in said plurality of said hard-drawn round wires to have a helix configuration identical to a helix configuration of all other hard-drawn round wires in said plurality for forming a ruggedization layer having a radial thickness equal to a diameter of only one hard-drawn round wire; and applying a protective jacket of plastic material surrounding said ruggedization layer.

17. A method as claimed in claim 16 for internally ruggedizing a low attenuation microwave coaxial cable for use in the GigaHertz frequency range including the further step of:

applying said bedding layer having a radial thickness about equal to a diameter of a round wire strand of said outer conductor.

18. A method for internally ruggedizing a low attenuation microwave coaxial cable for use in the GigaHertz frequency range having a center conductor extending along a central longitudinal axis of the coaxial cable, a dielectric surrounding said center conductor, a plurality of round wire strands adjacent one another extending longitudinally of the cable relative to said longitudinal axis, said wire strands having a helical lay along the cable and being in electrical contact with one another to realize an outer conductor encircling said dielectric, said method for internally ruggedizing a low attenuation microwave coaxial cable comprising the steps of:

applying a bedding layer of indentable dielectric material encircling said outer conductor;

helically winding a ruggedization layer of hard-drawn wire around said bedding layer, said helically wound hard-drawn wire in said ruggedization layer having turns;

positioning said turns adjacent one another;

helically laying each turn of said hard-drawn wire along the cable at a helix angle of at least 50° relative to said longitudinal axis of the cable;

winding said hard-drawn wire in said ruggedization layer sufficiently tightly around said bedding layer for indenting said hard-drawn wire partially into said bedding layer; and applying a protective jacket of plastic material surrounding said ruggedization layer.

19. A method as claimed in claim 18 for internally ruggedizing a low attenuation microwave coaxial cable for use in the GigaHertz frequency range, including the further step of:

simultaneously helically winding a plurality of hard-drawn round steel wires, each of said plurality of said hard-drawn round steel wires having an outer coating of silver and each having a diameter of at least about three times a diameter of a round wire strand of said outer conductor, for forming said ruggedization layer; and providing for said plurality of said hard-drawn round steel wires to be a number in a range from two to twenty.

20. A low attenuation microwave coaxial cable for use in the GigaHertz frequency range having a center conductor extending along a central longitudinal axis of the coaxial cable, a dielectric surrounding said center conductor, a plurality of conductive round wire strands adjacent one another and extending longitudinally of the cable relative to said central longitudinal axis, said conductive round wire strands having a helical lay along the cable and being in electrical contact with one another to realize an outer conductor encircling said dielectric, said microwave coaxial cable further comprising:

a bedding layer of indentable dielectric material encircling said outer conductor;

a plurality of hard-drawn round wires, all of a same diameter, helically wound around said bedding layer in side-by-side contact sufficiently tightly for partially indenting each of said plurality of said hard-drawn round wires into said bedding layer;

said plurality of said hard-drawn round wires each having a helical lay along the cable at a helix angle of at least about 50° relative to said central longitudinal axis; and a protective jacket of plastic material surrounding said ruggedization layer.

21. A low attenuation microwave coaxial cable for use in the GigaHertz frequency range, as claimed in claim 20, in which:

said plurality of said hard-drawn round wires are hard-drawn round steel wires each having an outer coating of silver; and each of said plurality of said hard-drawn round steel wires has a diameter at least equal to about three times a diameter of a conductive round wire strand of said outer conductor.

22. A low attenuation microwave coaxial cable for use in the GigaHertz frequency range, as claimed in claim 20, further comprising:

said bedding layer having a radial thickness about equal to a diameter of a conductive round wire strand of said outer conductor; and each of said plurality of said hard-drawn round wires having a diameter at least equal to about three times the diameter of a conductive round wire strand of said outer conductor.

* * * * *